US007150634B2

(12) United States Patent
Kamata et al.

(10) Patent No.: US 7,150,634 B2
(45) Date of Patent: Dec. 19, 2006

(54) CONNECTOR IN WHICH RELIABLE GROUND CONNECTION IS ASSURED

(75) Inventors: Kazushi Kamata, Aomori (JP); Koji Hayashi, Tokyo (JP); Nobukazu Kato, Tokyo (JP)

(73) Assignees: Japan Aviation Electronics Industry, Limited, Tokyo (JP); JAE Hirosaki, Ltd., Hirosaki (JP)

( * ) Notice: Subject to any disclaimer, the term of this patent is extended or adjusted under 35 U.S.C. 154(b) by 0 days.

(21) Appl. No.: 11/165,012

(22) Filed: Jun. 23, 2005

(65) Prior Publication Data

US 2005/0287847 A1 Dec. 29, 2005

(30) Foreign Application Priority Data

Jun. 25, 2004 (JP) ..... 2004-188923

(51) Int. Cl.
*H01R 4/66* (2006.01)
*H01R 13/648* (2006.01)
*H01R 13/627* (2006.01)

(52) U.S. Cl. ..... 439/95; 439/358; 439/101

(58) Field of Classification Search ..... 439/95, 439/96, 101, 108, 607, 610, 357, 358, 353, 439/350, 98, 352–354, 579, 497, 492
See application file for complete search history.

(56) References Cited

U.S. PATENT DOCUMENTS

| | | | | |
|---|---|---|---|---|
| 4,842,529 | A * | 6/1989 | Frantz et al. | 439/95 |
| 5,240,424 | A * | 8/1993 | Honma et al. | 439/95 |
| 6,039,583 | A * | 3/2000 | Korsunsky et al. | 439/101 |
| 6,045,380 | A * | 4/2000 | Hashimoto | 439/248 |
| 6,074,223 | A * | 6/2000 | Huang | 439/95 |
| 6,115,257 | A * | 9/2000 | Laity | 439/101 |
| 6,165,008 | A | 12/2000 | Wu et al. | |
| 6,234,828 | B1 | 5/2001 | Kuo | |
| 6,315,616 | B1 * | 11/2001 | Hayashi | 439/108 |
| 6,929,500 | B1 * | 8/2005 | Noro | 439/358 |

* cited by examiner

*Primary Examiner*—Felix O. Figueroa
(74) *Attorney, Agent, or Firm*—Collard & Roe, P.C.

(57) ABSTRACT

In a connector, an insulator has a mount portion. Signal and ground contacts are held by the insulator, each having a terminal portion placed on the mount portion. A shell member surrounds the insulator. The mount portion includes a groove portion corresponding to the terminal portion of the ground contact. The shell has a terminal portion inserted into the groove portion and clamped between the terminal portion of the ground contact and a bottom of the groove portion.

13 Claims, 6 Drawing Sheets

CONNECTOR IN WHICH RELIABLE GROUND CONNECTION IS ASSURED

This application claims priority to prior Japanese patent application JP 2004-188923, the disclosure of which is incorporated herein by reference.

BACKGROUND OF THE INVENTION

This invention relates to a connector having a plurality of contacts and suitable for use in differential transmission.

A connector of the type has a metal shell surrounding a plurality of contacts via an insulator. At least one of the contacts is used as a ground contact and, therefore, electrically connected to the shell. Specifically, a terminal portion of the shell is provided with a spring portion. The ground contact is elastically contacted with the spring portion.

However, if an external force is applied to the shell, the spring portion may be displaced. This results in unstable contact between the spring portion and the ground contact.

In case of a connector used for connection of a thin-wire coaxial cable, a ground connection must be made via a ground bar attached to the cable. As a result, the connector is complicated in structure.

SUMMARY OF THE INVENTION

It is therefore an object of the present invention to provide a connector in which a ground contact can reliably and stably be contacted with a shell.

It is another object of the present invention to provide a connector which is simple in structure and has a robustness.

Other objects of the present invention will become clear as the description proceeds.

According to an aspect of the present invention, there is provided a connector comprising an insulator having a mount portion, a signal contact held by the insulator and having a terminal portion placed on the mount portion, a ground contact held by the insulator and having a terminal portion placed on the mount portion, and a shell member surrounding the insulator, the mount portion including a groove portion corresponding to the terminal portion of the ground contact, the shell having a terminal portion which is inserted into the groove portion and clamped between the terminal portion of the ground contact and a bottom of the groove portion.

DESCRIPTION OF THE PREFERRED EMBODIMENTS

Figure 1:
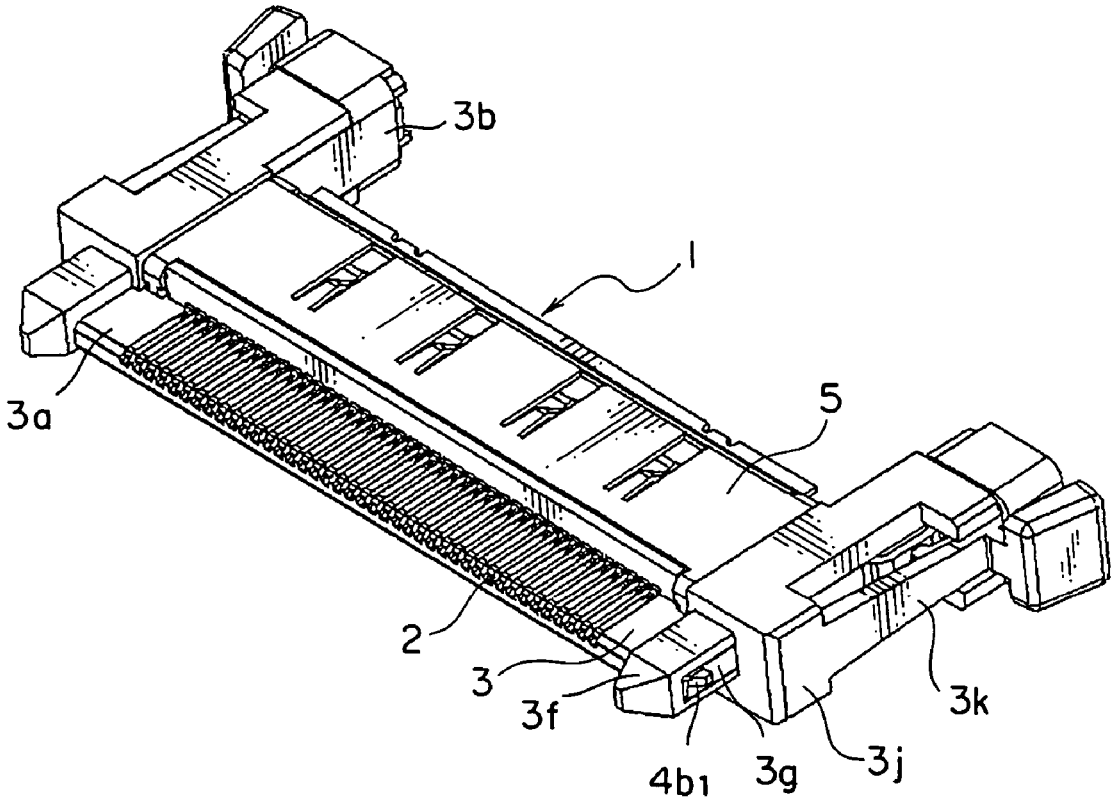
FIG. 1 is a rear perspective view of a connector according to an embodiment of the present invention.
Figure 2:
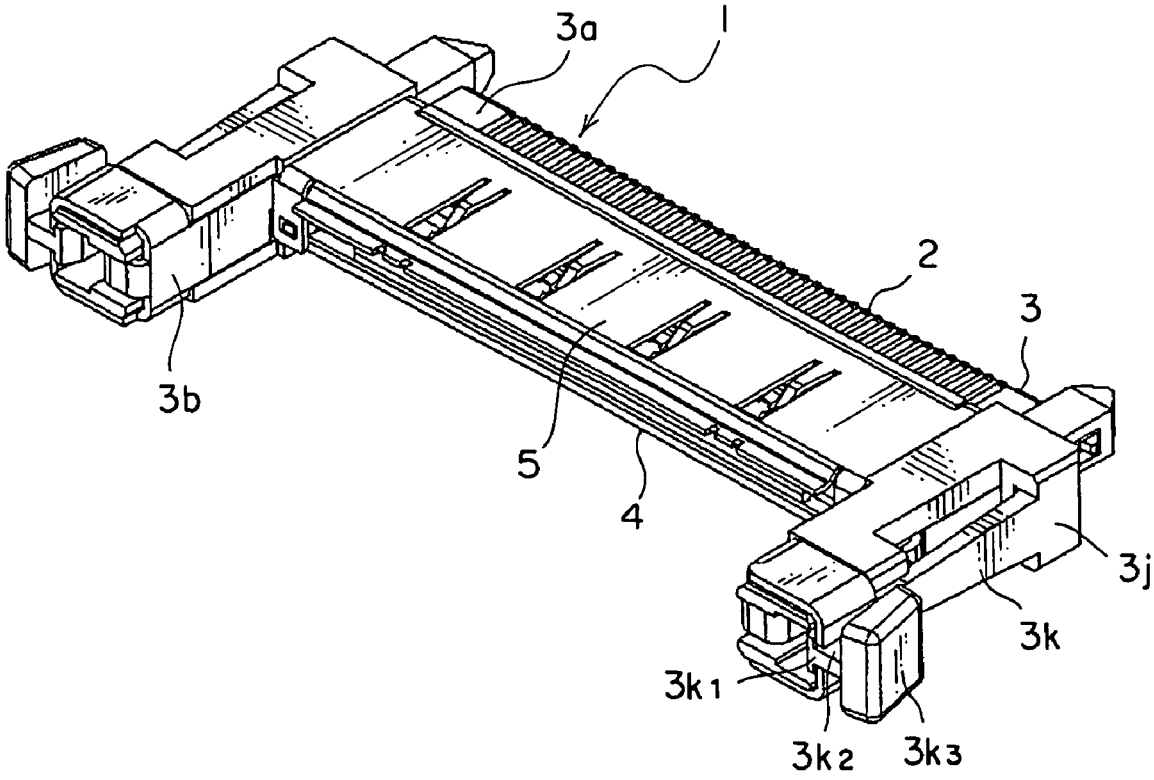
FIG. 2 is a front perspective view of the connector illustrated in FIG. 1.
Figure 3:
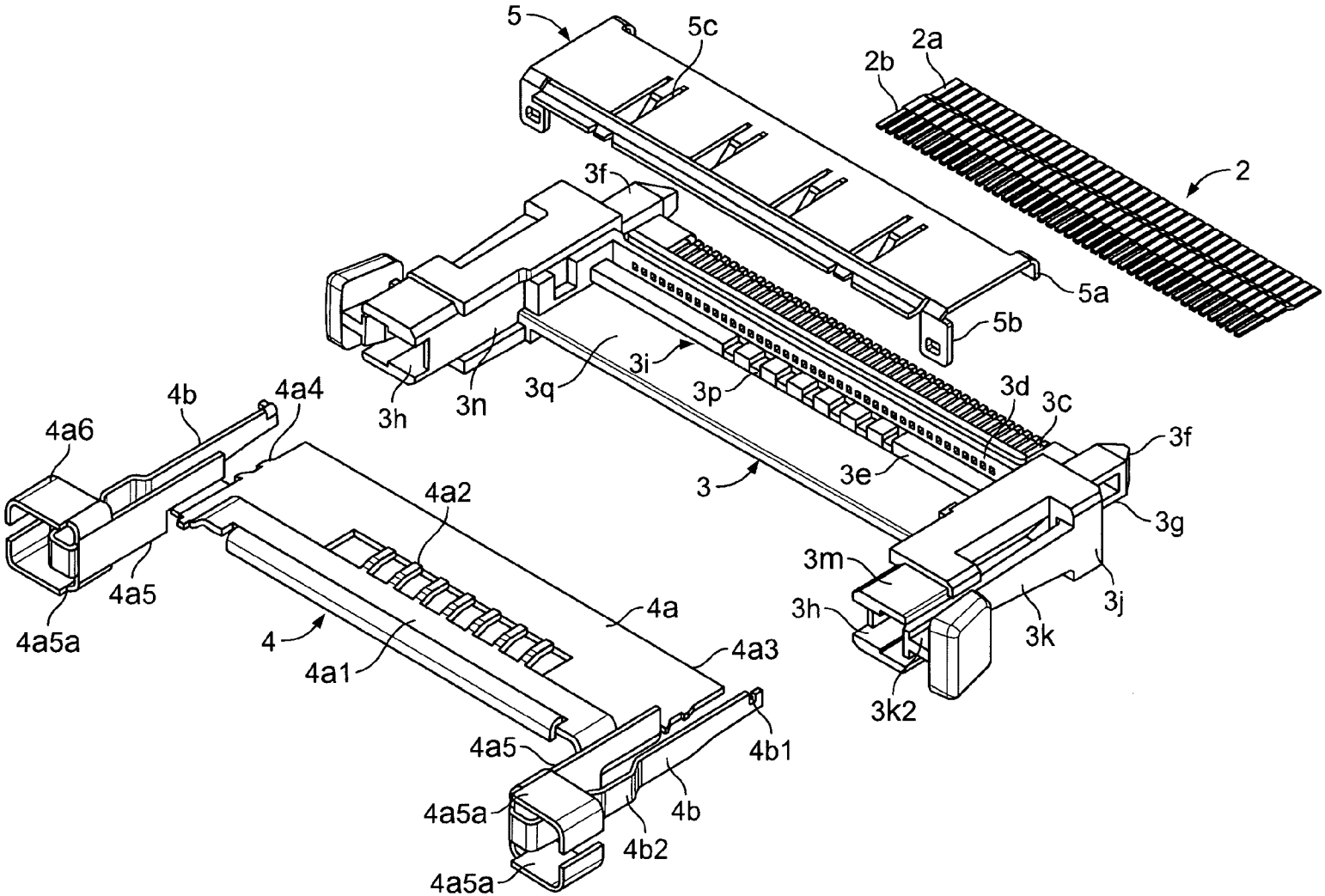
FIG. 3 is an exploded perspective view of the connector illustrated in FIG. 1.
Figure 4:
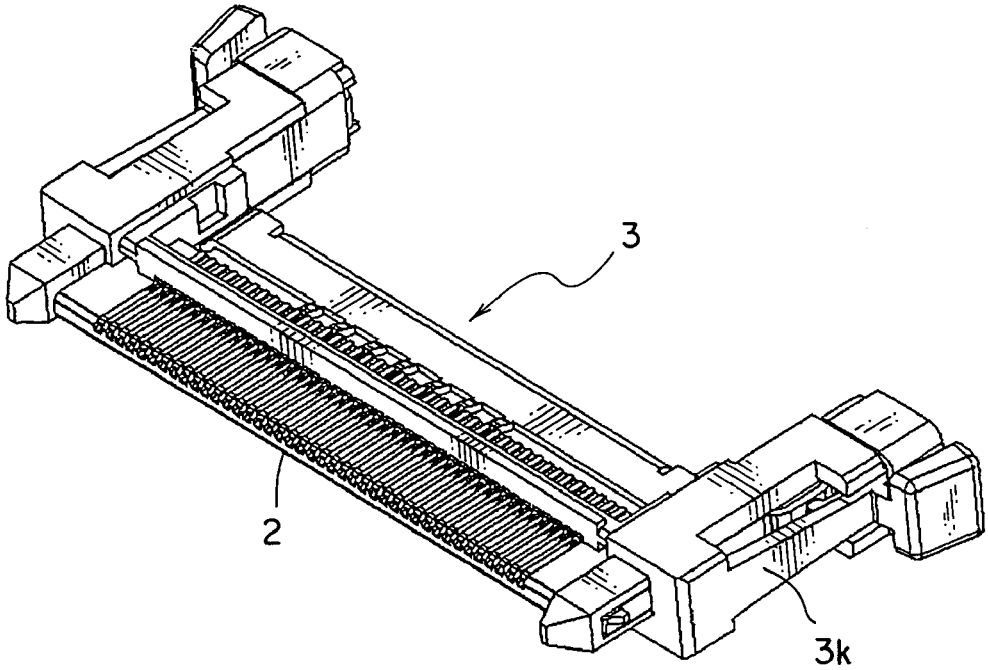
FIG. 4 is a front perspective view of the connector illustrated in FIG. 1 in a state where a shell is removed therefrom.
Figure 5:
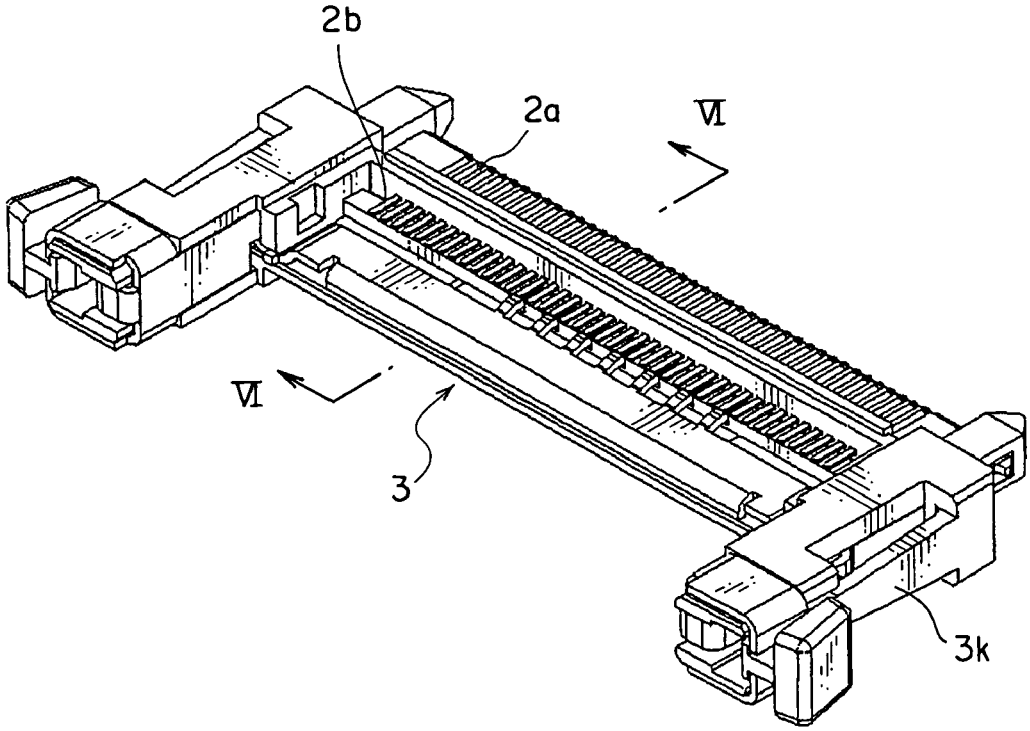
FIG. 5 is a rear perspective view of the connector illustrated in FIG. 1 in the state where the shell is removed therefrom.
Figure 6:
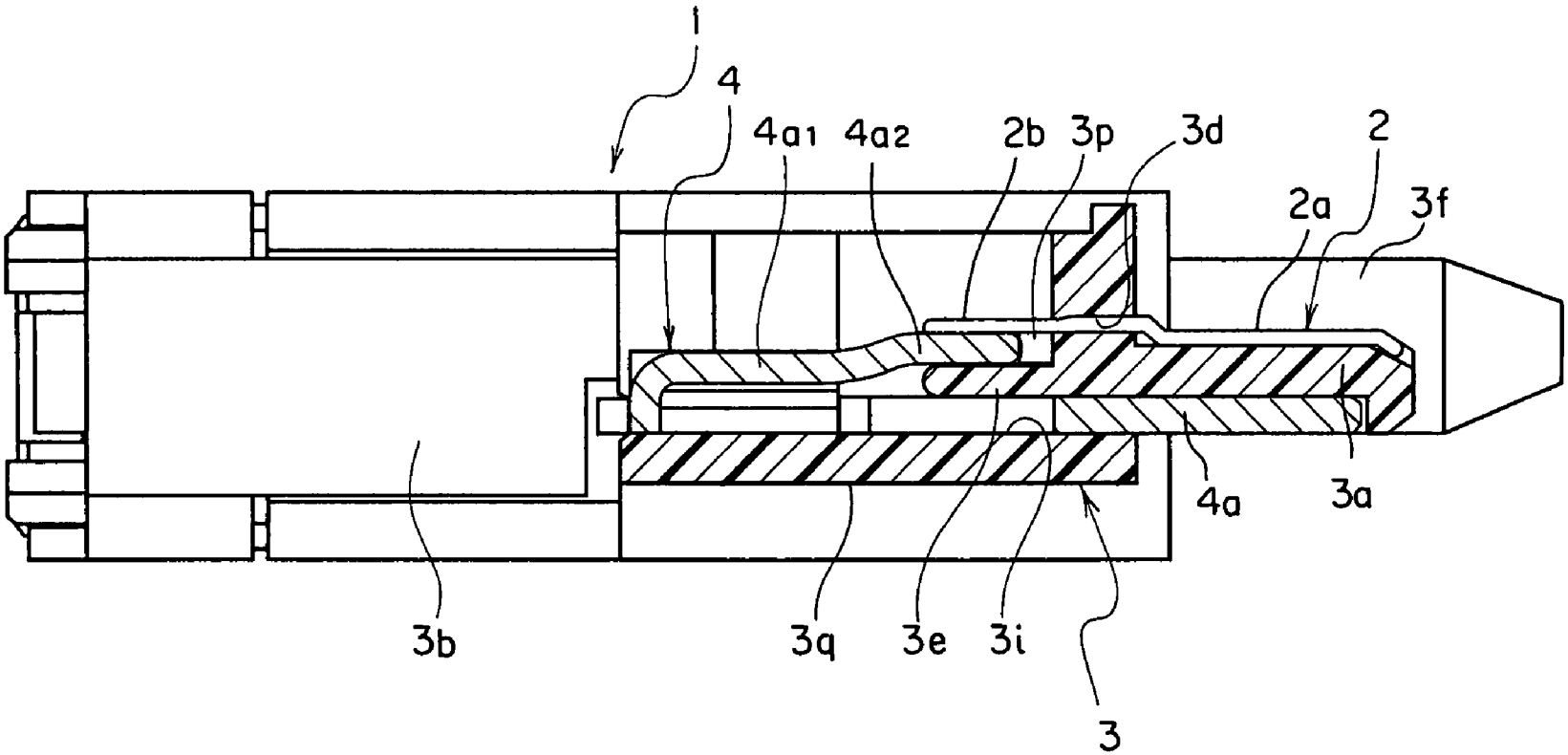
FIG. 6 is a sectional view taken along a line VI—VI in FIG. 5.

Referring to FIGS. 1 to 6, description will be made of a connector according to an embodiment of the present invention.

The connector illustrated in FIGS. 1 to 6 is a cable connector 1 to be connected to a cable (not shown). The cable connector 1 comprises a plurality of contacts (including signal contacts and ground contacts) 2, an insulator 3 holding the contacts 3, a lower shell 4, and an upper shell 5. Each of the contacts 2 is formed by pressing a metal plate and has a contacting portion 2*a* and a terminal portion (soldering portion) 2*b*. The lower shell 4 comprises a main body 4*a* and a pair of lock springs 4*b* integrally formed on opposite ends of the main body 4*a*.

The insulator 3 is made of a resin material and has a fitting portion 3*a* and a main body portion 3*b*. The fitting portion 3*a* is provided with a plurality of contact grooves 3*c*. A plurality of contact holes 3*d* extend from the contact grooves 3*c* towards the main body portion 3*b*, respectively. Each contact hole 3*d* has an exit opened on the side of the main body portion 3*b* and faced to a mount portion or a platform 3*e* serving as a wiring portion.

The fitting portion 3*a* has a pair of guide posts 3*f* integrally formed on left and right front ends thereof to guide fitting of the cable connector 1 and a mating connector (which will later be described). Each guide post 3*f* has a lock groove 3*g* formed on its outer side surface. The main body portion 3*b* has a pair of insertion holes 3*h* formed on left and right rear ends thereof to receive the lock springs 4*b* to be inserted therein, respectively. The insulator 3 is provided with a plate portion 3*q* facing the mount portion 3*e* to form a through hole 3*i* therebetween. The through hole 3*i* extends from the main body portion 3*b* to a lower surface of the fitting portion 3*a* to allow passage of a ground connecting portion 4*a*3 of the lower shell 4.

The insulator 3 has a pair of levers 3*k* of a cantilevered shape integrally formed on left and right side portions 3*j*, respectively. Each lever 3*k* has an end portion 3*k*1 provided with a groove portion 3*k*2 and a lever operating portion 3*k*3. The main body portion 3*b* is provided with stepped portions 3*m* formed on upper and lower surfaces on left and right sides thereof.

The lower shell 4 is formed by pressing a metal plate and has the main body 4*a* and the lock springs 4*b* arranged on left and right sides thereof. The main body 4*a* has a rear end provided with a cable-ground connecting portion 4*a*1 formed by drawing at a height corresponding to the size of the cable. The main body 4*a* is provided with a plurality of terminal portions 4*a*2 extending from the cable-ground connecting portion 4*a*1 towards a front end thereof. The main body 4*a* has the ground connecting portion 4*a*3 for the mating connector and a pair of press-fit portions 4*a*4 formed on left and right sides thereof to be press-fitted to the insulator 3.

The main body 4*a* has a pair of vertical wall portions 4*a*5 formed on left and right sides thereof. Each of the vertical wall portions 4*a*5 has a frame-like lever protecting portion 4*a*6. A lock spring 4*b* extends from a rear end face 4*a*5*a* of each vertical wall portion 4*a*5 in parallel to the vertical wall portion 4*a*5. Each lock spring 4*b* has a lock engaging portion 4*b*1 formed on its forward end.

The cable connector is assembled in the following manner.

The lock springs 4*b* of the lower shell 4 are inserted into the insertion holes 3*h* of the insulator 3, respectively. The lock engaging portions 4b1 protrude outward from the lock grooves 3g of the guide post 3f. At this time, the vertical wall portions 4a5 of the main body 4a are inserted into a pair of grooves 3n formed on left and right inner surfaces of the main body portion 3b, respectively. The lever protecting portions 4a6 are coupled with the stepped portions 3m. A pair of slits 4a6a of the lever protecting portions 4a6 are fitted to the groove portions 3k2 of the levers 3k. Thus, the levers 3k are prevented from being excessively deformed. The main body 4a passes through the through hole 3i of the insulator 3 and fixed to the insulator 3 by the press-fit portions 4a4.

The terminal portions 4a2 are fitted to a plurality of groove portions 3p formed on the insulator 3 and disposed at the bottom of the groove portions 3p. When the contacts 2 of the cable connector 1 are press-fitted into the contact holes 3d of the insulator 3, respectively, the contacting portions 2a are disposed on the contact grooves 3c and the terminal portions 2b are disposed on the mount portion 3e of the insulator 3. Those of the contacts 2 which are disposed in the groove portions 3p surmount upper surfaces of the terminal portions 4a2 of the lower shell 4, which are already fitted into the groove portions 3p, and are electrically connected to the terminal portions 4a2 to serve as ground contacts.

Thereafter, the upper shell 5 is overlaid on an upper surface of the insulator 3. Engaging portions 5a and 5b formed by bending on front and rear ends on left and right sides of the upper shell 5 are fixed to the insulator 3 and the lower shell 4, respectively. At this time, a plurality of spring portions 5c formed by cutting on an upper surface of the upper shell 5 are contacted with a metal member for common connection of ground portions in case where a thin-wire coaxial cable is used. The spring portions 5c are also adapted to be electrically connected to the cable-ground connecting portion 4a1 of the lower shell 4 owing to elasticity and to the contacts 2 serving as the ground contacts through the terminal portions 4a2.

Figure 7:
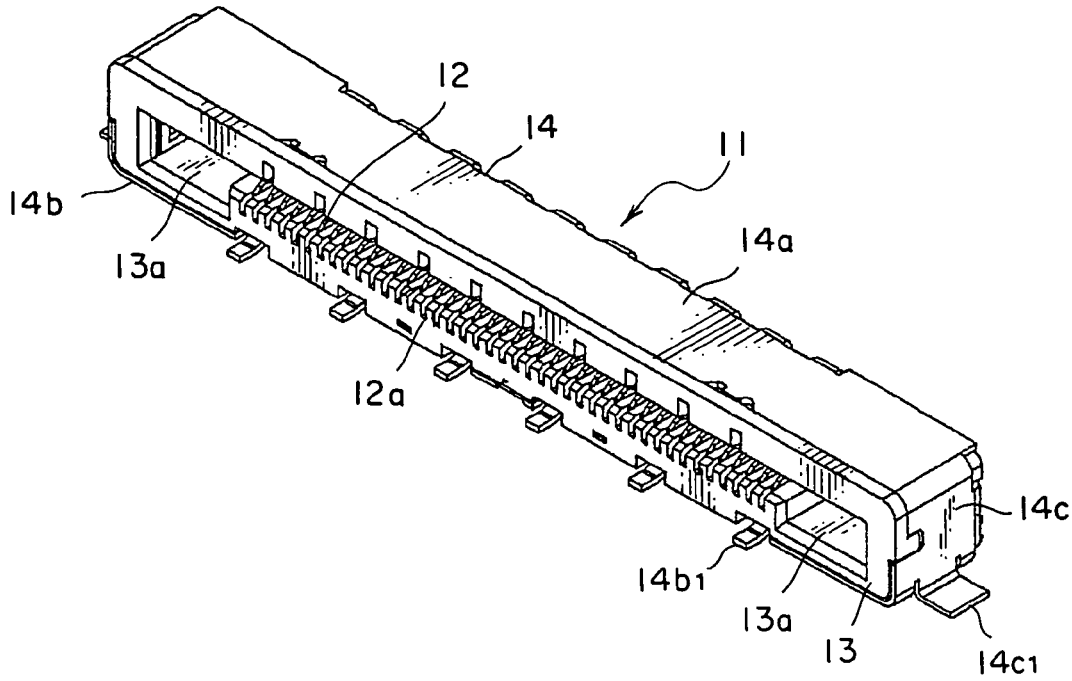
FIG. 7 is a front perspective view of a mating connector to be connected to the connector illustrated in FIG. 1.
Figure 8:
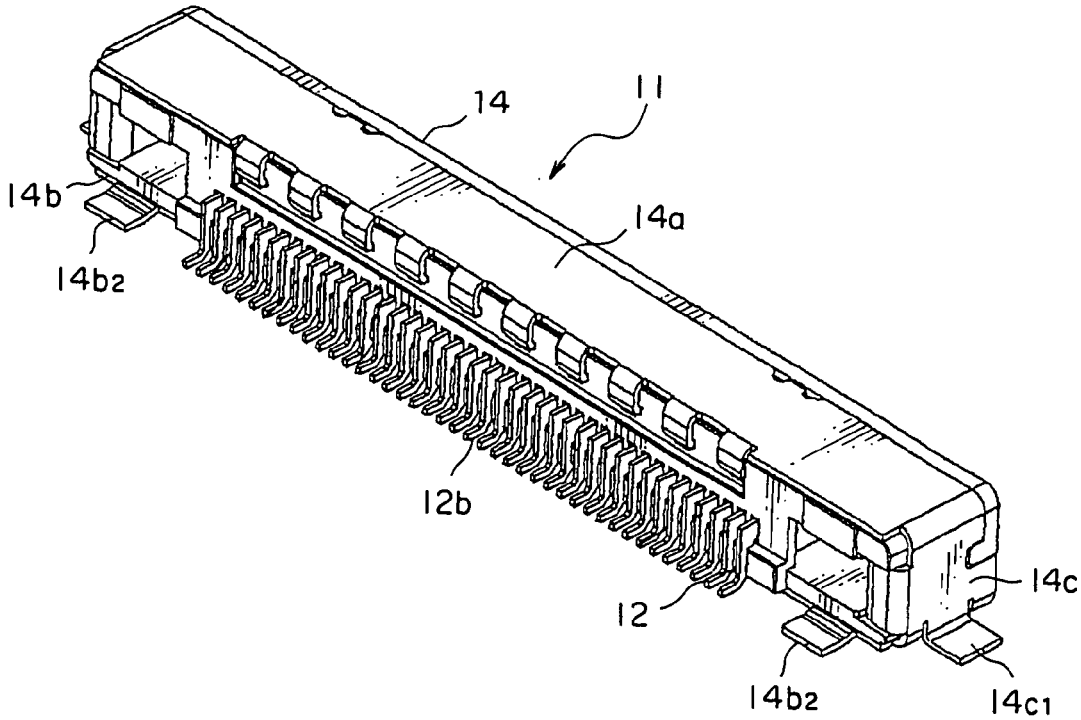
FIG. 8 is a rear perspective view of the mating connector illustrated in FIG. 7.

Referring to FIGS. 7 and 8, description will be made of the mating connector 11 to be connected to and disconnected from the cable connector 1.

The mating connector 11 comprises a plurality of contacts 12, an insulator 13 holding the contacts 12, and a shell 14. Each of the contacts 12 is formed by pressing a metal plate and has a contacting portion 12a and a terminal portion (soldering portion) 12b. The insulator 13 is made of a resin material and has a pair of guide holes 13a formed on left and right sides thereof to receive the guide posts 3f of the cable connector 1 to be inserted therein, respectively.

The shell 14 is formed by a metal plate into a generally rectangular frame and has an upper surface portion 14a, a lower surface portion 14b, and a pair of left and right side surface portions 14c. The lower surface portion 14b is provided with a plurality of soldering portions 14b1 formed on its front side and two soldering portions 14b2 formed on its rear side. Each of the side surface portions 14c is provided with a soldering portion 14c1.

The cable connector 1 and the mating connector 11 are connected to and disconnected from each other in the following manner.

The guide posts 3f of the cable connector 1 are inserted into the guide holes 13a of the mating connector 11. Then, the lock engaging portions 4b1 of the lower shell 4 of the cable connector 1 are engaged with lock holes (not shown) formed on the opposite side surface portions 14c of the shell 14 of the mating connector 11, respectively. Consequently, the cable connector 1 and the mating connector 11 are fixed in a fitted state. At this time, the contacting portions 2a of the contacts 2 of the cable connector 1 are connected to the contacting portions 12a of the contacts 12 of the mating connector 11.

In order to disconnect the cable connector 1 from the mating connector 11, the lever operating portions 3k3 of the levers 3k of the cable connector 1 are held by operator's fingers and pushed inward. Then, the levers 3k push protruding portions 4b2 of the lock springs 4b inward so that the lock springs 4b are elastically deformed. As a consequence, the lock engaging portions 4b1 are pulled out from the lock holes of the mating connector 11 to be unlocked. Thereafter, the cable connector 1 is disconnected from the mating connector 11.

While the present invention has thus far been described in connection with the preferred embodiment thereof, it will readily be possible for those skilled in the art to put this invention into practice in various other manners. Although description is made about the connector including a plurality of signal contacts and a plurality of ground contacts, the connector may include only a single signal contact and a single ground contact. In this event, it is a matter of course that the mount portion has a single groove portion and that the lower shell has a single cable-ground connecting portion.

What is claimed is:

1. A connector comprising:

an insulator having a mount portion;

a signal contact held by the insulator and having a terminal portion placed on the mount portion;

a ground contact held by the insulator and having a terminal portion placed on the mount portion; and a shell member surrounding the insulator, the mount portion including a groove portion corresponding to the terminal portion of the ground contact, the shell having a terminal portion which is inserted into the groove portion and clamped between the terminal portion of the ground contact and a bottom of the groove portion, wherein the shell member includes a ground connecting portion and a cable-ground connecting portion connected to a cable and having ends connected to the ground connecting portion, the terminal portion of the shell extending from the cable-ground connecting portion and being inserted into the groove portion.

2. The connector according to claim 1, wherein the shell member further includes a spring portion being in elastic contact with the cable-ground connecting portion.

3. The connector according to claim 2, wherein the shell member comprises lower and upper shells having conductivity and coupled to each other, the insulator being placed between the lower and upper shells, the lower shell being provided with the ground connecting portion and the cable-ground connecting portion, the upper shell being provided with the spring portion.

4. The connector according to claim 3, wherein the insulator further has a plate portion facing the mount portion to form a through hole therebetween, the ground connecting portion being inserted in the through hole.

5. The connector according to claim 3, wherein the insulator has a guide post having a lock groove, the lower shell having a lock spring having a lock engaging portion protruding from the lock groove to be engaged with a mating connector when the connector is fitted to the mating connector.

6. The connector according to claim 1, wherein the insulator has a guide post having a lock groove, the shell member having a lock spring having a lock engaging portion to be engaged with a mating connector, the lock engaging portion protruding from the lock groove, the lock engaging portion being engaged with a lock hole formed on a shell of the mating connector when the connector is fitted to the mating connector.

7. A connector comprising:

an insulator having a mount portion;

a signal contact held by the insulator and having a terminal portion placed on the mount portion;

a around contact held by the insulator and having a terminal portion placed on the mount portion; and a shell member surrounding the insulator, the mount portion including a groove portion corresponding to the terminal portion of the around contact, the shell having a terminal portion which is inserted into the groove portion and clamped between the terminal portion of the ground contact and a bottom of the groove portion, wherein the shell member has a lock spring to be engaged with a mating connector, the insulator having a lever integrally formed therewith to disconnect the connector from the mating connector, the shell member having a slit fitted to a groove portion formed on the lever to prevent excessive deformation of the lever.

8. The connector according to claim 7, wherein the shell member includes a ground connecting portion and a cable-ground connecting portion having ends connected to the ground connecting portion, the terminal portion of the shell extending from the cable-ground connecting portion and being inserted into the groove portion.

9. The connector according to claim 8, wherein the shell member further includes a spring portion being in elastic contact with the cable-ground connecting portion.

10. The connector according to claim 9, wherein the shell member comprises lower and upper shells having conductivity and coupled to each other, the insulator being placed between the lower and upper shells, the lower shell being provided with the ground connecting portion and the cable-ground connecting portion, the upper shell being provided with the spring portion.

11. The connector according to claim 10, wherein the insulator further has a plate portion facing the mount portion to form a through hole therebetween, the ground connecting portion being inserted in the through hole.

12. The connector according to claim 10, wherein the insulator has a guide post having a lock groove, the lower shell having a lock spring having a lock engaging portion protruding from the lock groove to be engaged with a mating connector when the connector is fitted to the mating connector.

13. The connector according to claim 7, wherein the insulator has a guide post having a lock groove, the shell member having a lock spring having a lock engaging portion to be engaged with a mating connector, the lock engaging portion protruding from the lock groove, the lock engaging portion being engaged with a lock hole formed on a shell of the mating connector when the connector is fitted to the mating connector.

* * * * *